United States Patent [19]

Calvert

[11] 4,159,841

[45] * Jul. 3, 1979

[54] BOTTLE CARRIER

[75] Inventor: Rodney K. Calvert, Dunwoody, Ga.

[73] Assignee: The Mead Corporation, Dayton, Ohio

[ * ] Notice: The portion of the term of this patent subsequent to Nov. 11, 1989, has been disclaimed.

[21] Appl. No.: 790,383

[22] Filed: Apr. 25, 1977

Related U.S. Application Data

[63] Continuation of Ser. No. 586,328, Jun. 12, 1975, abandoned.

[51] Int. Cl.[2] ..... B65D 71/00

[52] U.S. Cl. ..... 294/87.2; 206/159; 224/45 AA

[58] Field of Search ..... 294/87.2, 87.28; 206/153, 106, 199, 145, 157, 158, 160, 428, 423; 229/28 R; 220/23.4; 215/100 R; 224/45 AA, 45 AB, 45 C, 45 P; D9/178, 52, 291–293

[56] References Cited

U.S. PATENT DOCUMENTS

| | | | |
|---|---|---|---|
| 3,370,700 | 2/1968 | DeShazor, Jr. | 206/159 |
| 3,633,962 | 1/1972 | Erickson | 294/87.2 |

*Primary Examiner*—James B. Marbert

*Attorney, Agent, or Firm*—Harold L. Marquis; Walter M. Rodgers; Erwin Doerr

[57] ABSTRACT

An integrally formed bottle carrier with a plurality of spaced split collars in which bottles can be locked into and supported by their neck-shoulders and removed, each collar supported by an individual frame interconnected to an adjoining frame by a ribbed member, and a plurality of flexible tabs attached to the sides of the bottle carrier to permit machine loading of bottles into the bottle carrier.

3 Claims, 7 Drawing Figures

BOTTLE CARRIER

This application is a continuation of my application Ser. No. 586,328, filed June 12, 1975, now abandoned.

This invention relates to an integrally formed bottle carrier of plastic material capable of supporting a plurality of bottles by their neck-shoulders and which is capable of being machine loaded with bottles.

The bottle carrier of the present invention is an improvement on the bottle carrier of the type described in the Erickson U.S. Pat. No. 3,633,962, issued Jan. 11, 1972, which discloses an integrally formed bottle carrier in which the neck-shoulders of bottles are supported by uniformly split collars. Each collar is mounted in an individual frame to which the split ends of the collar and plurality of other points on the collar are attached. The individual frames are interconnected to a main frame to provide a structure that is sufficiently rigid to support the bottles.

While the Erickson carrier satisfactorily supports bottles, it has several drawbacks. In order for a carrier to be commercially successful it is essential that bottles can be loaded by a machine into the carrier. Unfortunately, the Erickson carrier is not too satisfactory for machine loading as it has no device to facilitate the movement of the carrier into precise alignment above the bottles and to permit its accurate release onto the neck-shoulders of bottles below. The Erickson carrier also uses a larger quantity of plastic than is commercially desirable. With the escalation in the price of petroleum-based plastics, it is desirable to design a plastic carrier that uses a smaller quantity of plastic, but retains sufficient rigidity to securely support the bottles.

In this improvement of the Erickson carrier, a plurality of flexible tabs project from the side of the carrier to facilitate machine loading of bottles. Referring to FIG. 1 of the Erickson patent, the internal frames 11 are interconnected with a continuous outside frame 10. In this improvement the quantity of plastic used is reduced by eliminating one of the frames so that there is only a single frame surrounding each collar. Sufficient rigidity is maintained by connecting each individual frame to an adjoining frame by a ribbed member. Referring to FIG. 1 of the Erickson patent, the collar is also split opposite the split ends to provide an opening 19. This split end is connected by a yoke 20 which is connected to the individual frame 11 by a connection 21. Additional material was saved and the rigidity of the split collar increased by forming this opening in the body of the individual frame.

For a more complete understanding of the present invention, reference can be made to the preferred embodiments below and to their accompanying drawings, in which.

Figure 1:
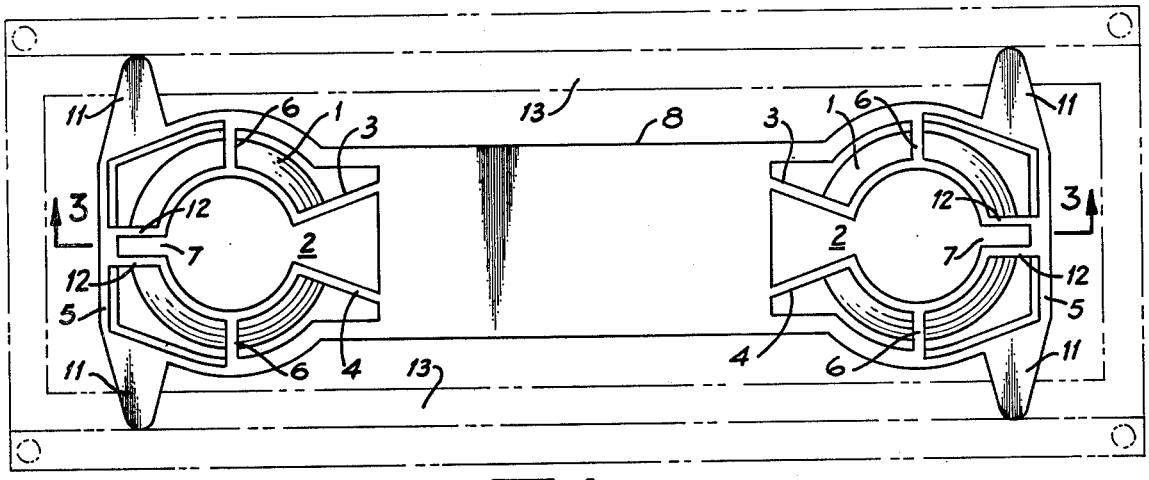
FIG. 1 is a plan view of the two-bottle carrier of the present invention positioned on the horizontal loading tracks of a machine for loading the carrier onto bottles.
Figure 2:
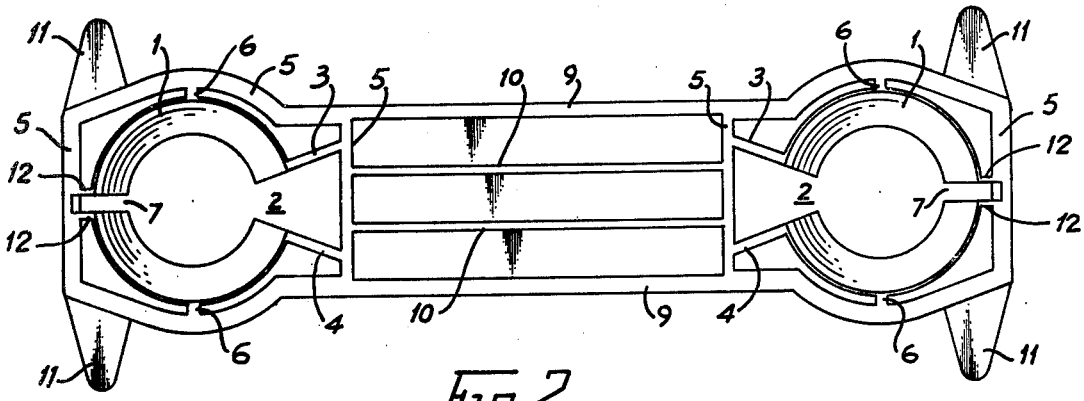
FIG. 2 is a view similar to FIG. 1 of the carrier as seen from below.

The construction of the two-bottle carrier of this invention as shown in FIG. 1 and FIG. 2 includes two split collars 1 at opposite ends of the carrier, with each split collar 1 capable of supporting the enlarged neck-shoulder of a bottle.

Figure 3:
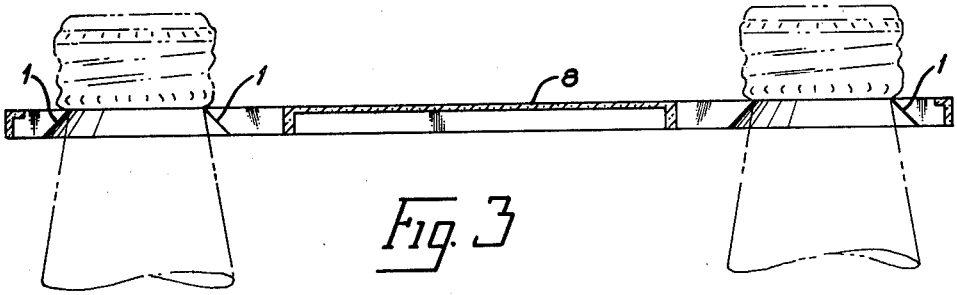
FIG. 3 is a sectional view of a split collar of a two-bottle carrier taken along the line 3—3 of FIG. 1, looking in the direction of the arrows.

Each split collar 1 is of a conical shape with a larger diameter at the bottom than at the top of the collar, as shown in FIG. 3, which facilitates the insertion and removal of bottles from the bottom of the split collar. Each collar 1 is split with a large opening 2 with a connection 3 and 4 which taper away from each other in the direction from the collar to the portions of the individual frame 5 to which they are connected. This taper facilitates spreading the ends of the split collar during loading and removal of bottles, while restraining the collar 1 from accidentally spreading and releasing the bottle when it is supporting a bottle. Each split collar 1 is supported within its individual frame 5 by a plurality of connections 6.

In this two-bottle carrier, the large openings 2 of each collar face each other to facilitate the removal of a bottle by rotating the bottle about its axis which passes through the connections 6 in the direction so the bottom of the bottle is moved outwardly from the end of the carrier forcing the neck through the large opening 2 thereby releasing the bottle from the carrier. If these openings were adjacent the ends of the carrier, the first bottle could not be easily removed as the other bottle would be in the line of travel in which the first bottle would need to be rotated.

In the preferred embodiment of this invention, the collar 1 is also split to form a small opening 7 opposite the large opening 2. The split ends 12 of this small opening 7 are attached to the individual frame 5. This small opening 7 facilitates spreading of the collar 1 during the insertion and removal of a bottle. Forming the small opening 7 directly into the individual frame 5 strengthens the rigidity of the split collar 1 and decreases its tendency to turn as a bottle is removed.

Each individual frame 5 is connected to its adjacent frame by a ribbed member 8. The ribs 9 and 10 maintain the strength of the carrier while permitting less plastic to be used. Preferably the outer ribs 9 have a diameter approximately twice the diameter of the interior ribs 10. This ribbed member 8 serves as a handle in carrying the bottles.

Attached on opposite sides of each individual frame 5 near the ends of the carrier are flexible tabs 11. These tabs are used in supporting the carrier while it is guided into the proper position in the loading machine. The tabs 11 rest on two horizontal tracks 13 on which the carrier is moved to and maintained in the proper position above the bottles. When properly positioned a plunger bar (not shown) forces the carrier onto the bottle necks below. The flexible tab 11 is of sufficient flexibility to readily bend as the carrier is forced downwardly onto the bottles and thus releases the carrier from its position between the horizontal tracks. This loading machine is described in detail in Calvert and Fishback U.S. Pat. No. 3,859,773, issued Jan. 14, 1975. While two tabs 11 on each side are shown in FIG. 1, a single tab on each side as shown in the four-bottle carrier of FIG. 4, may be sufficient if properly positioned to guide the carrier into proper position during loading. A single tab on one side of the carrier would be sufficient to temporarily support the carrier with certain types of loading machines.

While not shown, three or more split collars 1 can be interconnected in a single row by ribbed members 8.

Figure 4:
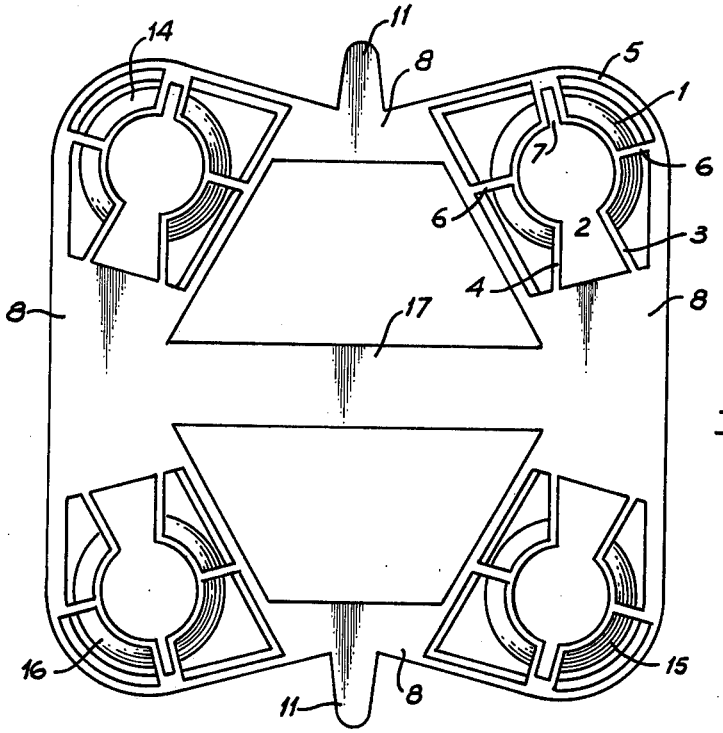
FIG. 4 is a plan view of the four-bottle carrier of this invention as seen from above.
Figure 5:
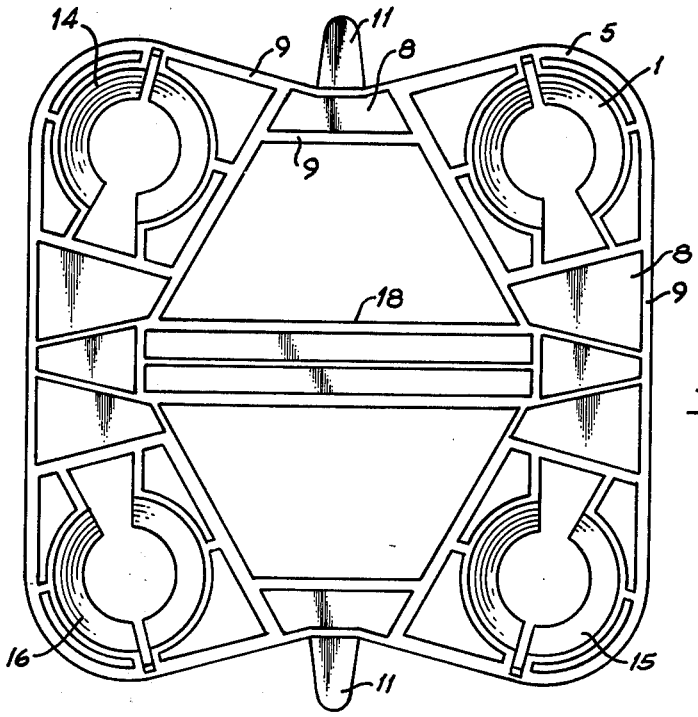
FIG. 5 is a view similar to FIG. 4 of the four-bottle carrier as seen from below.

The construction of the four-bottle carrier of this invention as shown in FIGS. 4 and 5 includes the split collar 1 and individual frame 5 construction as shown for the two-bottle carrier. Each of the individual frames 5 is connected to its adjacent frames by ribbed members 8. Because the stresses are somewhat different that in the two-bottle carrier, the ribs 9 are arranged differently.

The split collars of the four-bottle carrier are arranged in two rows with collar 1 (as shown in FIG. 4) being in the same row as collar 14 while collars 15 and 16 are in the same row. The large openings 2 of each collar face inwardly into the carrier. Preferably the large opening 2 of each collar is turned slightly towards the adjacent end of the carrier to facilitate easy removal and insertion of bottles.

The four-bottle carrier may have a handle attached to opposite ribbed members 8. The handle 17 is ribbed 18 to strengthen the carrier. The single tab 11 located midway on each side of this carrier is attached on the outside edge of ribbed member 8 rather than on the individual frame 5 as shown in FIG. 1 for the two-bottle carrier.

Figure 6:
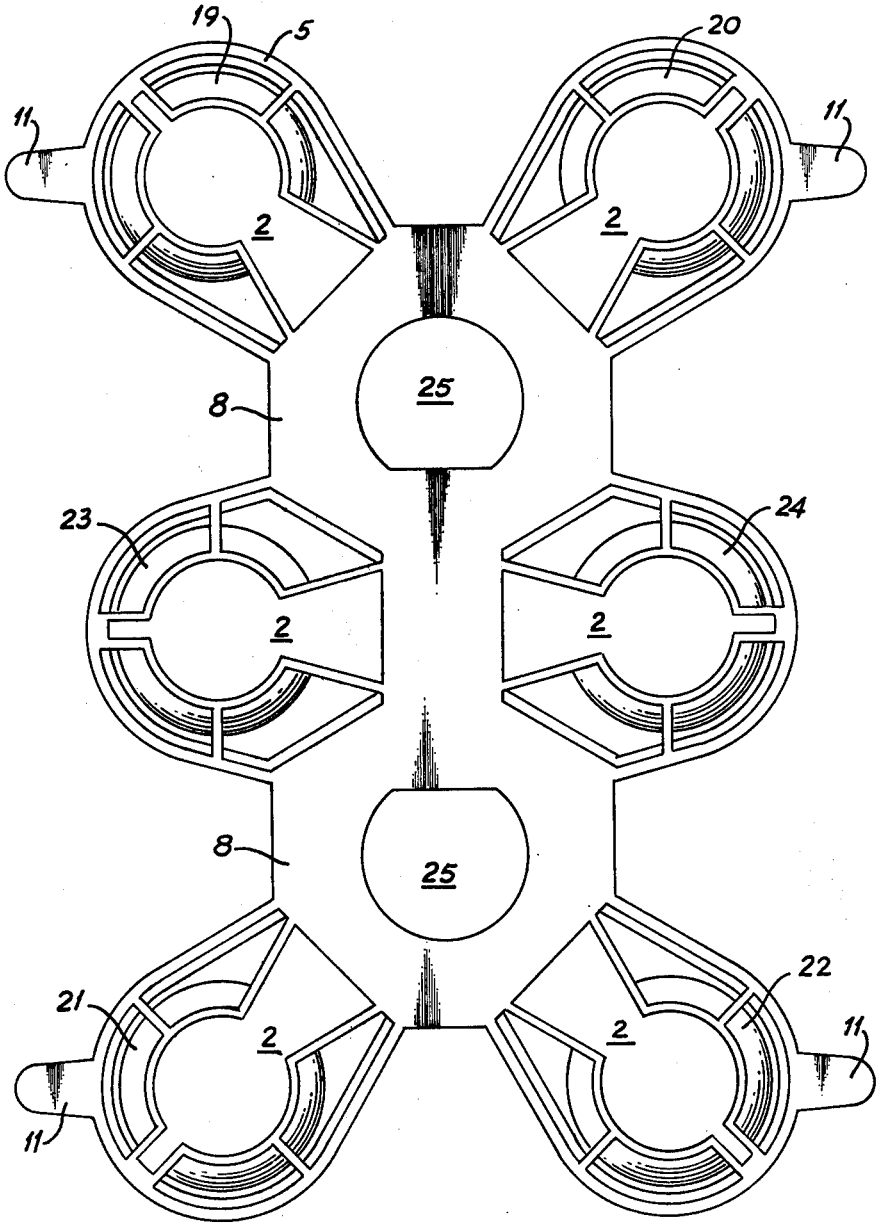
FIG. 6 is a plan view of the six-bottle carrier of this invention as seen from above.
Figure 7:
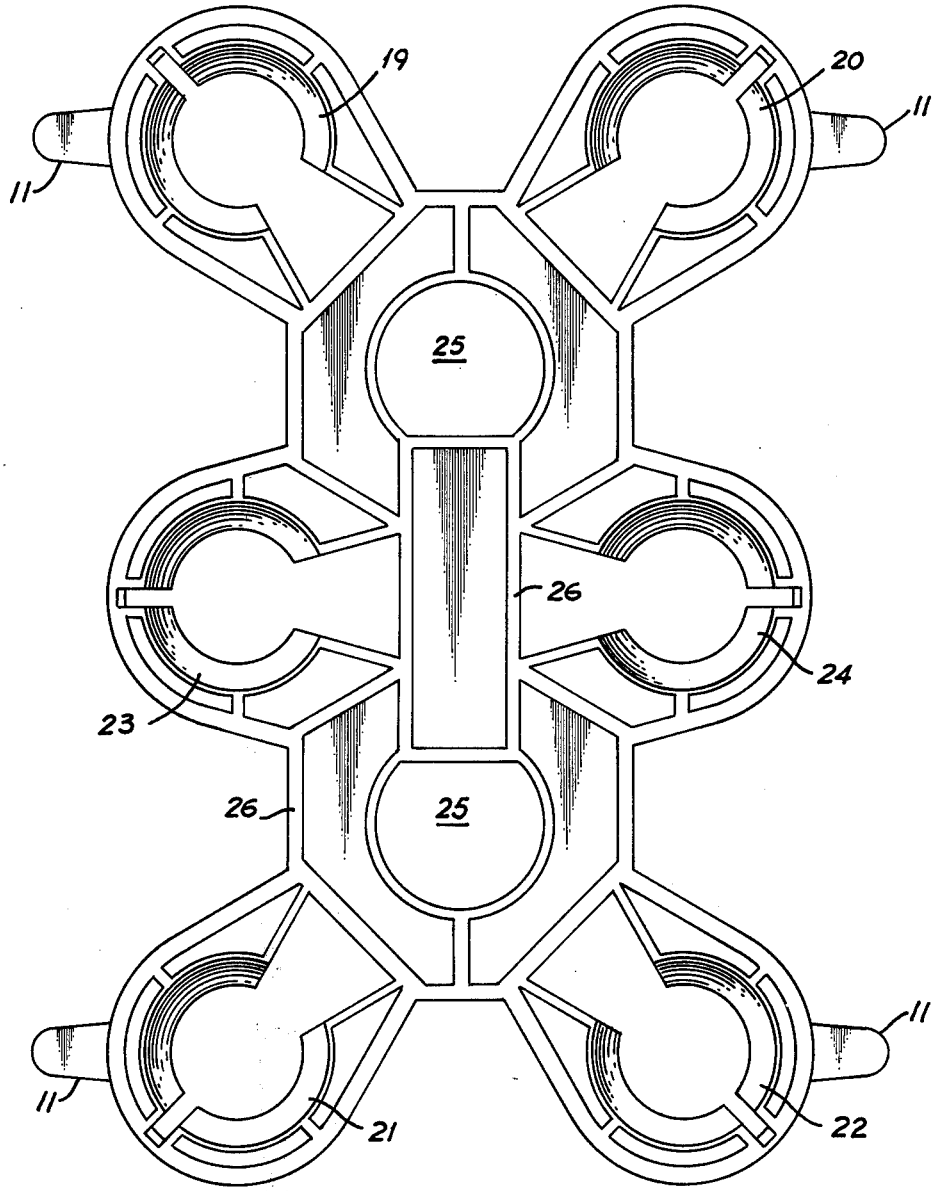
FIG. 7 is a view similar to FIG. 6 of the six-bottle carrier as seen from below.

A six-bottle carrier is shown in FIGS. 6 and 7. The split collars 19 and individual frames 5 are constructed as previously described. A tab 11 is attached on the side of the individual frame 5 in each corner of the carrier. The large openings 2 of the adjacent end split collars 19 and 20, and also the adjacent split collars 21 and 22 on the other end, face inwardly toward the center of the carrier. The openings of the two center split collars 23 and 24 directly face each other. This arrangement of the large openings 2 of collars is necessary to facilitate ease of bottle insertion and removal. The individual frames 5 in the six-bottle carrier are interconnected by ribbed members 8, with ribs 26 arranged somewhat differently than in the two-bottle carrier and from the four-bottle carrier because of different stresses. Two finger openings 25 may be provided in the carrier for ease of handling.

The bottle carrier is preferably molded in one piece of a relatively rigid material, but possessing some flexibility, such as a high-density polyethylene. A small amount of material is needed to produce the carrier of this invention than the corresponding Erickson carrier. The ribbed members 8 provide sufficient strength to prevent the carrier from sagging under the weight of heavy bottles. The bottle carriers can be thrown away after each use or reloaded for returning empty bottles to the store.

Obviously many modifications and variations are possible in light of the above teachings. The tabs 11 can be used in the machine loading of bottle carriers having spaced bottle neck griping collars of various designs. It is, therefor, to be understood that within the scope of the invention may be individual modifications and variations other than as specifically described.

The embodiments of the invention in which an exclusive property or privilege is claimed are defined as follows:

1. In a bottle carrier made of relatively rigid flexible plastic material and comprising a plurality of spaced collars for receiving and supporting therein the enlarged neck-shoulders of bottles and a structural member interconnecting said collars, the improvement which comprises at least one flexible tab attached to said carrier at opposite sides thereof and projecting outwardly beyond the confines of said carrier, said tabs being arranged to temporarily support said carrier on spaced tracks of a loading machine above a group of bottles and being of sufficient flexibility to readily bend upwardly and thus to release said carrier from said tracks as it is forced downwardly onto the tops of said bottles, said collars being surrounded by individual frames and said flexible tabs being attached to said individual frames adjacent the ends of said carrier.

2. The bottle carrier according to claim 1 wherein said tabs are attached to said interconnecting structural member intermediate of said collars.

3. The bottle carrier according to claim 1 wherein said interconnecting structural member is provided with reinforcing ribs.

* * * * *